United States Patent [19]

Piai et al.

[11] Patent Number: 4,566,970

[45] Date of Patent: Jan. 28, 1986

[54] WASHING MACHINE FILTER

[75] Inventors: Dino Piai; Renzo Rigoni; Giovanni Paruzzolo, all of Treviso, Italy

[73] Assignee: Industrie Zanussi S.p.A., Pordenone, Italy

[21] Appl. No.: 604,363

[22] Filed: Apr. 26, 1984

[30] Foreign Application Priority Data

May 5, 1983 [IT] Italy ..... 45713 A/83

[51] Int. Cl.[4] ..... B01D 35/02

[52] U.S. Cl. ..... 210/409; 210/380.2; 210/460; 210/497.01; 68/18 F; 134/153

[58] Field of Search ..... 68/18 F, 18 FA; 210/167, 403, 409, 460, 461, 449, 482, 483, 360.1, 360.2, 380.1, 380.2, 497.01; 134/153, 109, 110, 111; 209/288

[56] References Cited

U.S. PATENT DOCUMENTS

| | | | |
|---|---|---|---|
| 2,103,966 | 12/1937 | Behan | 68/18 F |
| 2,287,628 | 6/1942 | McMahan | 68/18 F |
| 2,413,954 | 1/1947 | Conterman | 68/18 F |
| 2,439,535 | 4/1948 | Wilson | 68/18 F |
| 3,407,633 | 10/1968 | Giambertoni | 68/18 F |
| 3,543,542 | 12/1970 | Bochan | 68/18 F |
| 3,774,418 | 11/1973 | Ohmann | 68/18 F |

*Primary Examiner*—Richard V. Fisher
*Assistant Examiner*—Wanda L. Millard
*Attorney, Agent, or Firm*—Wenderoth, Lind & Ponack

[57] ABSTRACT

A washing machine filter includes a housing having an open first end adapted to be mounted adjacent a wall of a washing machine and a closed second end. The housing has a first connection to be connected to a wash tub of the washing machine to receive therefrom water to be filtered and a second connection to be connected to a pump of the washing machine for discharging the filtered washing water. A filtering body extends through the open end of the housing and into the interior thereof. The body has an outer end sealed to the housing and an inner end extending freely into the interior of the housing. The body has therethrough filtering openings for filtering the water passing between the first and second connections of the housing. A shut-off cover is removably connected to the other end of the filtering body for sealing the open first end of the housing. The filter housing and filtering body are curved and extend obliquely downwardly away from the ends thereof adjacent the washing machine wall. The overflow level of the opening defining the open first end of the housing is higher than the maximum level of the second connection of the housing.

3 Claims, 3 Drawing Figures

WASHING MACHINE FILTER

BACKGROUND OF THE INVENTION

The present invention relates to a washing machine filter, more particularly for use with a household washing machine. As a rule, in the discharge unit of a washing machine there is provided a filtering body that is removably inserted in a suitable housing provided in the piping connecting the wash tub to the discharge pump.

The majority of filters pass horizontally through the discharge piping and extend into the interior of the machine. This complicates the utilization of the internal space of the machine, especially in a washing machine having a compact size such as, for example, a top-loading washing machine. In addition, because of their shape and arrangement, the meshes of the filtering surface of the filter are not utilized uniformly, and areas of continuing clogging are created near the filter outlet opening, which becomes obstructed in a short time. Another drawback is caused by any heavy objects retained by the filter and which remain on the most-favored path of the circulating liquid, which further impedes the regular outflow of the washing water.

In addition, in washing machines fitted with this type of filter the stagnant water inside the machine flows out from the opening for introducing the filtering body whenever the cover thereof is removed to perform intermittent operations of inspection and cleaning of the filtering surface. To avoid this loss of water, the user is forced to take measures to counteract the effects of this shortcoming, but which leave the causes thereof intact, such as for example laboriously keeping the appliance inclined as long as the filter housing is without its cover, or arranging catch basins beforehand at positions beneath the filter housing opening.

SUMMARY OF THE INVENTION

Therefore, a major object of the present invention is to provide a filter for a washing machine that allows a more rational exploitation of the internal spaces of the washing machine.

Another object of the invention is to create a filter of the aforementioned type in which the filtering surface is uniformly exploited and in which any heavy object held back thereby will not obstruct the most-favored flow of the washing water being discharged from the washing machine.

Finally, it would be desirable, and this is another object of the invention, to avoid unwanted outflow of the water through the filter housing opening whenever the cover is removed for inspection and cleaning of the filtering body.

The above and other objects are achieved according to the teachings of the invention by the provision of a filter for a washing machine, more particularly for a household washing machine, comprising a housing located in the piping connecting the wash tub to the discharge pump and adapted to receive from an opening in the side of the washing machine a meshed filtering body which has one end removably connected in a hermetically sealed manner to a cover of the housing and another end extending freely into the interior of the housing. The housing and the filtering body are curved and extend obliquely downwardly from a wall of the washing machine. The overflow level of the opening for inserting the filtering body is located at a level higher than the maximum level of the suction connecting piece of the discharge pump.

BRIEF DESCRIPTION OF THE DRAWINGS

Other objects, features and advantages of the invention will be better understood from the following description in conjunction with the accompanying drawings, wherein.

DETAILED DESCRIPTION OF THE INVENTION

Figure 1:
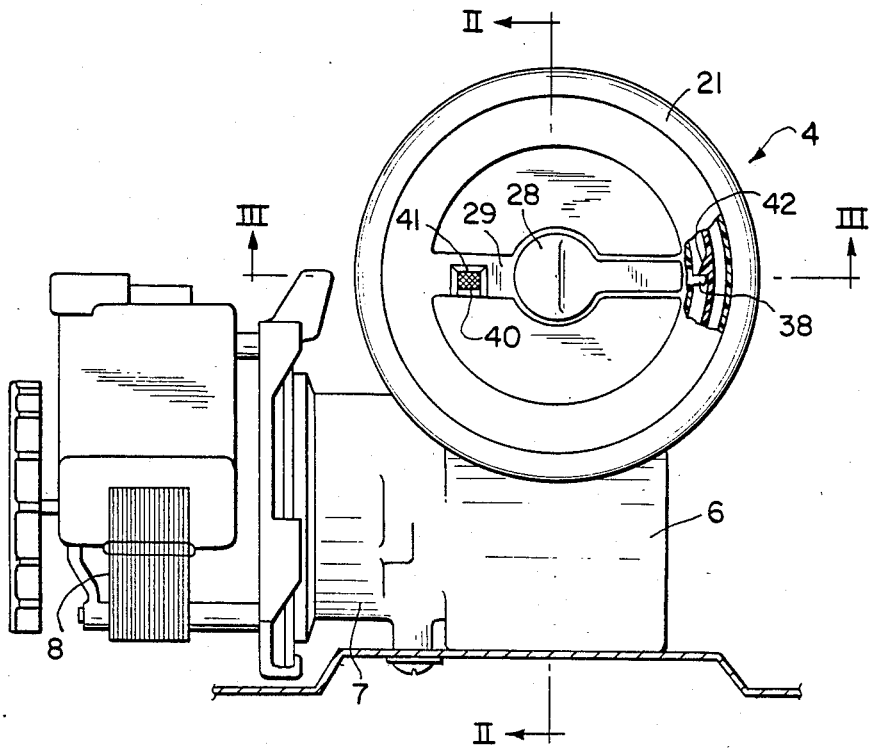
FIG. 1 is an elevation front view of a filter according to the invention, partially in section.

The filtering device 4 depicted in the drawings, given solely by way of non-limiting example, is used in a household washing machine 5 and includes a housing 6 (FIG. 2) curved obliquely downwards and having a connecting piece 7 (FIG. 1) for connection to a discharge pump 8 of the washing machine, a connecting piece 9 (FIG. 2) for connection to a wash tub 10 of the washing machine, by means of a bellows-type sleeve 11, and an inspection opening 12 through which is introduced into housing 6 a filtering body 13 removably connected to a cover 21.

More specifically, bellows-type sleeve 11 has, at the end for connection to wash tube 10 (FIG. 2), a depression 14 that defines a settling compartment for detergent spills occurring with the first loading of water into the tub. Depression 14 collects and keeps in contact with the lye present in wash tub 10, and therefore at the same temperature as the washing water, those portions of the detergent that would otherwise remain undissolved inside filter unit 4 and would subsequently be lost during the discharge operations from tub 10. Of considerable importance is the fact that the particular shape of filter 4 incorporating the invention enables the volume of space occupied by the filter to be reduced and to use such recovered valuable space for wash tub 10. In addition to these advantages, the filter according to the invention enables the overflow level of inspection opening 12 to be kept at a level which is higher than that of the upper level of the suction connecting piece 7 which is connected to pump 8. In this way, the stagnant water inside the filter housing is prevented from flowing out therefrom whenever shut-off cover 21 is removed from inspection opening 12.

Filtering body 13, also curved obliquely downwardly, has an arrangement of a plurality of filtering openings or meshes 15, 16 (FIG. 2) that are differentiated from each other. More specifically, the area of filtering body 13 adjacent to connecting piece 7 of the outlet of filter 4 has meshes 15 that are denser than meshes 16 of the other areas of filtering body 13.

Moreover, filtering body 13 has a cross section in the form of a semicircle that is open towards connecting piece 9 to wash tub 10. The lower end of filtering body 13 includes a bottom wall 17 adjacent a limited number of meshes 16 and with a vertical partition 18 (FIG. 2) capable of retaining on the bottom of filtering body 13 any heavy objects originating from wash tub 10, such as for example buttons, coins or the like. Consequently, such objects do not remain along the preferred path of the liquid and do not block the discharge flow to connecting piece 7 and pump 8. In addition, the wall of bottom 17 allows the recovery of any fibrous material that, as filtering body 13 moves past, might be detached from the meshes and fall back inside the filter. The opposite end of body 13 is closed by a circular wall 19 (FIG. 3) provided with a peripheral gasket 20 for sealing with respect to filter housing 6.

Another advantage according to filter 4 embodying the invention is the fact that with cover 21 closed and tub 10 filled with water, an air pocket is formed inside housing 6 at the upper region of the filter. The presence of this air pocket promotes the floating of stray fibrous material which then is retained by meshes 16 in an area remote from connecting piece 7 to pump 8. It should be noted that, as a result of the movement of the drum and the presence of the air pocket, the liquid inside filter 4 is forced to move continuously back and forth which, in addition to promoting the deposit of fibrous material in a high water zone remote from connecting piece 7, causes the discharge from the filter of any spilled detergent deposited therein. As described above, this positive effect is added to the settling effect in depression 14 of sleeve 11.

Furthermore, the above mentioned differentiation between meshes 15 and 16 compensates for the differences of turbulence taking place in filtering body 13 during the discharge phase. In fact, the wider meshes 16 stop the fibrous material present in low turbulence zones, while the denser meshes 15 retain the fibrous material in the vicinity of the high turbulence area adjacent to connecting piece 7 to pump 8.

The circular end 19 of filtering body 13 has on its outer surface (FIG. 3) a circular rib 22 with a triangular cross section and a seat 23 for receiving a screw system that connects the filter cover 21 to filtering body 13. Cover 21 is traversed by a circular hole 24 to allow the passage therethrough of seat 23 and, once the screw system is fixed, cover 21, if not tightly screwed onto opening 12, has allowance for sliding between two positions defined, respectively (FIG. 3), by a washer 25 secured to the screw system and by an annular projection 26 concentric with and located around seat 23.

Shut-off cover 21 of filter 4 of the invention has also been designed to prevent accidental or hurried openings even with the wash tub filled with water. In fact, cover 21 includes a locking mechanism that cooperates with a projection 27 provided adjacent the inner edge of opening 12 of filter housing 6. Such locking mechanism has a slider 28 that slides along curved portion 29 (FIG. 1) of cover 21 and is provided with a horizontal tie rod 30 and an inwardly projecting lock 31, as well as with a sliding carrier 32 having a front part 33 and a rear part 34 connected together by an annular element, not shown. More specifically, front part 33 has a display arm 35 and a ratchet catch 36, while rear part 34 has a housing 37 adapted to latch onto the free and appropriately shaped end portion of lock 31, and a ratchet tooth 38 adapted to engage or abut the projection 27 when lid 21 is screwed on.

Moreover, sliding carrier 32 can slide under the impulse of slider 28 against the action of a return spring 39 located between front part 33 and an inner surface of cover 21. Spring 39, when the locking mechanism is in a neutral position, presses against sliding carrier 32 and the slider 28 connected thereto to cause abutment against a limit stop provided on curved portion 29. Therefore, in the neutral position, the locking mechanism prevents cover 21 from being opened by causing ratchet tooth 38 to engage projection 27.

Figure 3:
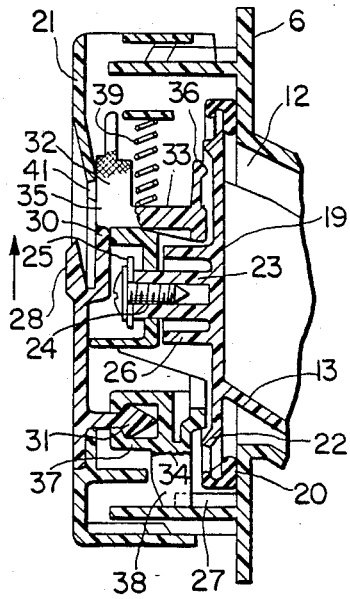
FIG. 3 is a cross-sectional view of the shut-off cover of the filter taken along the line III—III of FIG. 1.

To open the filter, the user must move slider 28 in the direction indicated by the arrow in FIG. 3 which, in turn, pushes sliding carrier 32 to slide against the force of return spring 39 both to disengage ratchet tooth 38 from projection 27 and to cause ratchet catch 36 to engage circular rib 22 so as to retain slider 28 in a position so that cover 21 may be rotated. At this point, unscrewing of cover 21 can be initiated because ratchet tooth 38 passes over projection 27 and, due to the clearance between cover 21 and seat 23, ratchet catch 36 can be disconnected from circular rib 22 and return spring 39 can return sliding carrier 32, and thereby slider 28, to the neutral position.

If filtering body 13 is to be separated from cover 21, it will be necessary to remove slider 28, releasing lock 31 from housing 37 in which it is inserted by snap fit. Thereafter, the screw system 24 can be actuated and the cover can be removed from filtering body 13 through through hole 24 provided in cover 21.

Figure 2:
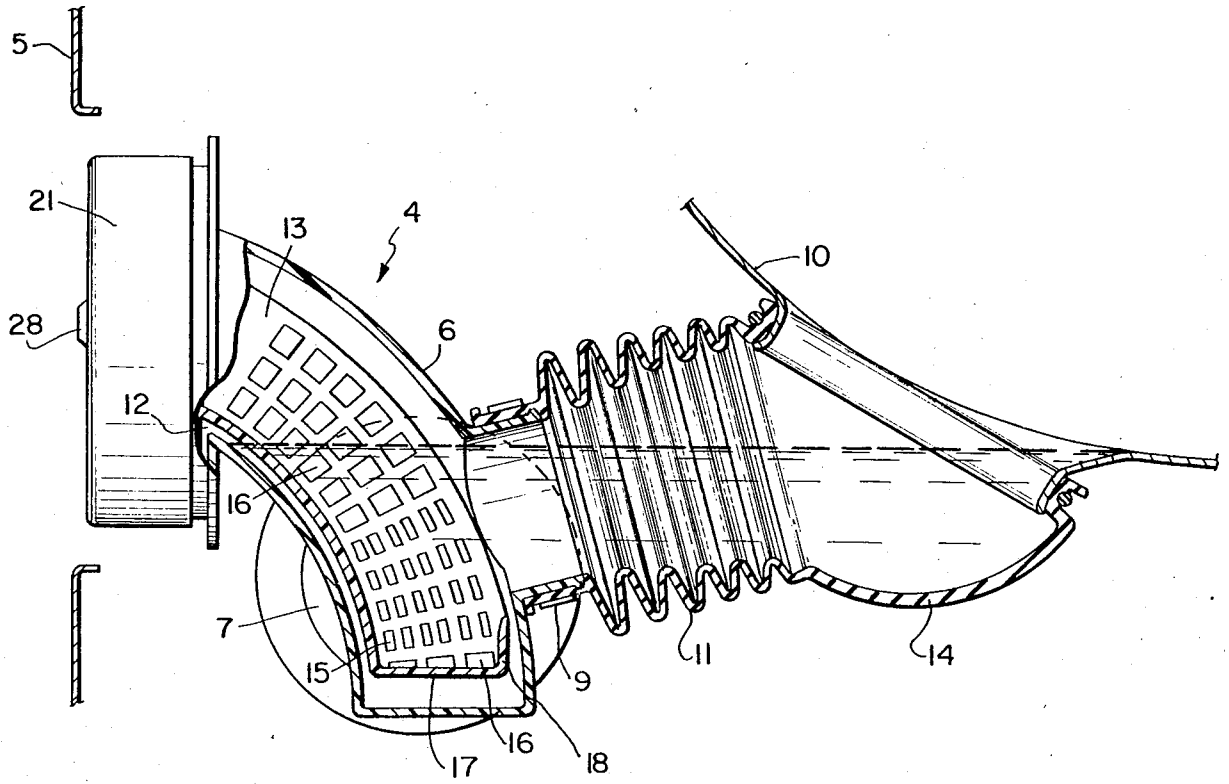
FIG. 2 is a cross-sectional view of the filter taken along the line II—II of FIG. 1.

To close cover 21 of filter 4, the operations described above are performed in reverse order except for the actuation of slider 28. When cover 21 is screwed in a clockwise direction, ratchet tooth 38 passes over projection 27 due to an inclined plane 42 which precedes it in clockwise direction (FIG. 1). Thereafter, ratchet tooth 38 is reinserted automatically in the safe or locked position by the action of return spring 39.

To provide for greater security, a colored display slot 40 (FIG. 1) on display arm 35 of sliding carrier 32 is returned by the user to a position to be visible through an appropriate window 41 provided in curved portion 29 of cover 21. By checking the position of slot 40, one can verify whether ratchet tooth 38 has indeed traveled to occupy the safe position after passing over inclined plane 42 adjacent to projection 27, so that in this position cover 21 cannot be opened except intentionally.

By making use of filter 4 of the invention, the volume of space of the washing machine occupied by the filter can be reduced considerably and the internal spaces can be rationally exploited to the advantage of the wash tub, for example. At the same time, the shape and arrangement of filter 4 allow all portions of the filtering surface to be utilized. In the lower zone of the body 13 heavy solids are held back. In the middle zone dense meshes are provided near the filter outlet. In an upper zone, due to the presence of the air pocket, most of the fibrous material carried by the discharge liquid is collected by floating and, as a result of the movements of the drum, there is a reciprocating motion which removes the fibrous material from the suction area of the pump and causes the removal of any detergent spills deposited in the filter.

It should also be noted that with the filter of the invention the problem of the water escape through the inspection opening is solved definitely. Also, the bellows-type sleeve provided in a simple manner with a settling compartment recovers detergent spills.

The differentiation of the meshes of filtering body 13 has been studied mainly on the basis of the various degrees of turbulence created in the different filter zones.

Finally, cover 21 of filter 4 of the invention is provided with a locking bolt or mechanism which in a reliable fashion prevents the inadvertent opening of the filter and which automatically restores the safety condition when the cover is screwed on. With the locking bolt is associated a display slot that automatically displays the condition of the restoration of the proper and safe position of the cover.

Although the present invention has been described and illustrated with respect to preferred features of the present invention, it is to be understood that various changes and modifications may be made to the described and illustrated arrangements without departing from the scope of the present invention.

We claim:

1. A washing machine filter for filtering water discharged from a washing machine, particularly a household washing machine, said filter comprising:

a filter housing having an open first end adapted to be mounted adjacent a wall of a washing machine and a closed second end, said housing having a first connection adapted to be connected to a wash tub of the washing machine to receive therefrom water to be filtered and a second connection adapted to be connected to a pump of the washing machine for discharging the washing water, said second connection having an upper edge;

a filtering body extending through said open first end and into the interior of said housing, said body having an outer end sealed to said housing and an inner end extending freely into said interior of said housing, and said body having therethrough filtering openings for filtering water passing between said first and second connections of said housing;

a shut-off cover removably connected to said outer end of said body for hermetically sealing said open first end of said housing;

said filter housing and said filtering body being curved and extending obliquely downwardly and away from said open first end and said outer end thereof, respectively;

said open first end of said housing being defined by an opening having a lower edge higher than said upper edge of said second connection, whereby upon removal of said cover water is prevented from overflowing from said housing through said opening;

said filtering openings in said body comprising smaller openings in the area of said body on a level with said second connection of said housing, and larger openings in other areas of said body; and said interior of said housing including an upper portion for retaining an air pocket above the level of water in said housing, such that fibrous material floats on the surface of the water at a level above said second connection.

2. A filter as claimed in claim 1, wherein said inner end of said body is defined by a closed bottom wall having extending upwardly therefrom a partition, thereby defining a bottom area capable of retaining heavy objects filtered from the water, said bottom area being positioned at a level beneath the level of said second connection of said housing.

3. A filter as claimed in claim 1, wherein said cover includes locking means for preventing inadvertent opening of said cover, said locking means comprising a locking bolt including a ratchet tooth abuttable with a projection extending from said housing adjacent said open first end thereof, and means for selectively disengaging abutment of said ratchet tooth with said projection, said disengaging means comprising a slider connected to a bolt and mounted on said cover for sliding movement with respect thereto between a first position, whereat said ratchet tooth engages said projection and prevents rotation of said cover, and a second position, whereat said ratchet tooth is disengaged from said projection, thereby enabling rotation of said cover, and a catch on said bolt for engagement with said body to maintain said bolt in said second position.

* * * * *